United States Patent [19]

Inoue

[11] Patent Number: 4,545,215

[45] Date of Patent: Oct. 8, 1985

[54] REFRIGERATION APPARATUS

[75] Inventor: Hiroshi Inoue, Shizuoka, Japan

[73] Assignee: Mitsubishi Denki Kabushiki Kaisha, Tokyo, Japan

[21] Appl. No.: 611,988

[22] Filed: May 18, 1984

[30] Foreign Application Priority Data

| | | | |
|---|---|---|---|
| May 23, 1983 | [JP] | Japan | 58-90265 |
| May 23, 1983 | [JP] | Japan | 58-90266 |
| May 23, 1983 | [JP] | Japan | 58-90267 |
| Sep. 2, 1983 | [JP] | Japan | 58-136403[U] |
| Sep. 2, 1983 | [JP] | Japan | 58-161657 |

[51] Int. Cl.[4] ..... F25B 41/04

[52] U.S. Cl. ..... 62/216; 62/498; 236/80 R

[58] Field of Search ..... 62/115, 216, 498; 230/80 F, 80 R

[56] References Cited

U.S. PATENT DOCUMENTS

| | | | |
|---|---|---|---|
| 2,326,093 | 8/1943 | Carter | 62/511 X |
| 2,331,264 | 10/1943 | Carter | 62/206 |
| 2,613,683 | 10/1952 | Baird et al. | 137/503 X |
| 4,267,702 | 5/1981 | Houk | 62/115 |
| 4,286,438 | 9/1981 | Clarke | 62/216 |

*Primary Examiner*—William E. Wayner

*Attorney, Agent, or Firm*—Oblon, Fisher, Spivak, McClelland & Maier

[57] ABSTRACT

A refrigeration apparatus comprising a compressor, a condenser, a pressure-reducing device and an evaporator connected sequentially in a loop. The loop includes a check valve placed between the outlet of said evaporator and the intake port of said compressor to prevent a refrigerant from flowing from the compressor side to the evaporator side; a pressure signal transmission pipe whose one end is connected to the outlet of said check valve to apply a pressure corresponding to the refrigerant pressure at the outlet side of said check valve and, a fluid control valve communicated with the other end of said pressure signal transmission pipe to control the refrigerant flowing to the inlet side of device in response to the refrigerant pressure in the other end of said pipe. The fluid control valve performs ON-OFF controlling operations depending on a difference in pressure between a pressure at the other end of said pressure signal transmission pipe and a pressure at the inlet side of said check valve while it automatically opens at the time of operation of said compressor and closes at the time of stoppage of said compressor.

1 Claim, 8 Drawing Figures

REFRIGERATION APPARATUS

The present invention relates to a refrigeration apparatus equipped with a compressor, a condenser, a pressure-reducing device and an evaporator. More particularly, it relates to a refrigeration apparatus for preventing energy loss caused by repeating operation and stoppage in a refrigeration cycle.

Generally, a refrigeration apparatus of a refrigerator repeatedly performs its cooling operations thereby maintaining a desirable temperature in the interior of the refrigerator. The stoppage of the cooling operation is effected by stopping a compressor such as a rotary compressor by feeding to it a signal for stopping the cooling operation whereby a refrigerant flowing in a refrigeration circuit is brought into a balanced condition. Namely, pressure is balanced between the high pressure side extending from a discharge valve through the interior of a shell to the compressor and the low pressure side extending from an evaporator to the intake port of the compressor, on account of which the refrigerant in the form of a highly pressurized super-heat gas flows in the evaporator at the low pressure side through a pressure-reducing device such as a capillary tube or through the sliding part in the compressor to thereby cause a temperature rise in the evaporator. Further, since a liquid refrigerant staying in the evaporator is directly returned to the compressor without being completely evaporated in the evaporator during the cooling operations, effective cooling of the interior of the refrigerator can not be accomplished for a few minutes after starting the cooling operations, hence there occurs energy loss.

There has been known an apparatus to eliminate the disadvantage as above-mentioned as shown in FIG. 1. The apparatus has a refrigeration circuit comprising a compressor 1 such as a rotary compressor using a rolling piston to elevate pressure in the shell, a condenser 2, pressure-reducing device 3 such as a capillary tube and an evaporator 4, in which an electromagnetic valve 6 is placed at the outlet side of the evaporator 2 and a check valve 7 is placed in a suction pipe 5 connecting between the outlet of the evaporator 4 and the intake port 1*a* of the compressor 1. With the construction as above-mentioned, the electromagnetic valve 6 is turned on and off in synchronism with a signal for stopping cooling operation to open and close the refrigeration circuit so that the refrigerant of a highly pressurized super-heated gas in the compressor is prevented from leakage from the sliding part of the compressor 1 to flow on the evaporator side, by means of the check valve 7.

The conventional apparatus as shown in FIG. 1 is, however, disadvantageous in that the electromagnetic valve 6 is expensive, much electric power is required and there are produced loud noise.

It is the first object of the present invention to eliminate the disadvantages of the conventional apparatus and to provide a refrigeration apparatus provided with a fluid control valve rapidly operating for control while reducing consumption of electric power and minimizing operational noise.

It is the second object of the present invention to provide a refrigeration apparatus comprising a compressor, a condenser, a pressure-reducing device and an evaporator connected sequentially in a loop, in which a check valve is placed between the outlet of the evaporator and the intake port of the compressor and a fluid control valve is placed in a refrigeration circuit at the inlet side of the pressure-reducing device or at the outlet side of the pressure-reducing device or between the inlet and the outlet of the pressure-reducing device, said fluid control device being so constructed as to open at the actuation of the compressor in response to the pressure difference between the inlet side and the outlet side of the check valve and to close at the stoppage of the compressor in an automatic manner.

It is the third object of the present invention to provide a refrigeration apparatus for reliable operation of a fluid control valve which is constituted by first and second pressure chambers defined by a diaphragm; by a pressure signal transmission pipe for transmitting a pressure to the first pressure chamber and means for suppressing pulsation of a pressure signal passing through the pipe.

It is the fourth object of the present invention to provide a refrigeration apparatus for preventing the temperature rise of an evaporator by effecting heat exchanging between a suction pipe and a pressure signal transmission pipe placed neighbouring the suction pipe at the outlet side of the evaporator.

It is the fifth object of the present invention to provide a refrigeration apparatus which comprises a pressure-reducing device constituted by first and second pressure-reducing devices and a fluid control valve interposed between the first and second pressure-reducing devices, the fluid control valve being opened and closed depending on pressure difference between a pressure at the intake port side of the compressor and a pressure at the inlet side of the second pressure-reducing device so that the valve is closed when the pressure at the intake port side of the compressor is higher than that of the inlet side of the second pressure-reducing device and the valve is opened when the former is lower than the latter.

It is the sixth object of the present invention to provide a refrigeration apparatus comprising a fluid control valve placed between the outlet of a condenser and the inlet of a pressure-reducing device and a muffler placed between a compressor and a check valve, in which the fluid control valve is opened and closed depending on a pressure difference between a pressure at the upstream side of the check valve and a pressure at the downstream side of the check valve so that the fluid control valve is closed when the pressure at the downstream side of the check valve is higher than the pressure at the upstream side of the check valve and the fluid control valve is opened when the former is lower than the latter and in which a pressure signal transmission pipe is connected between the check valve and the muffler at the downstream side of the check valve.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

A first embodiment of the present invention will be described in detail with reference to FIG. 2. In FIG. 2, the same reference numerals as in FIG. 1 designate the same or corresponding parts and the description is therefore omitted.

Figure 1:
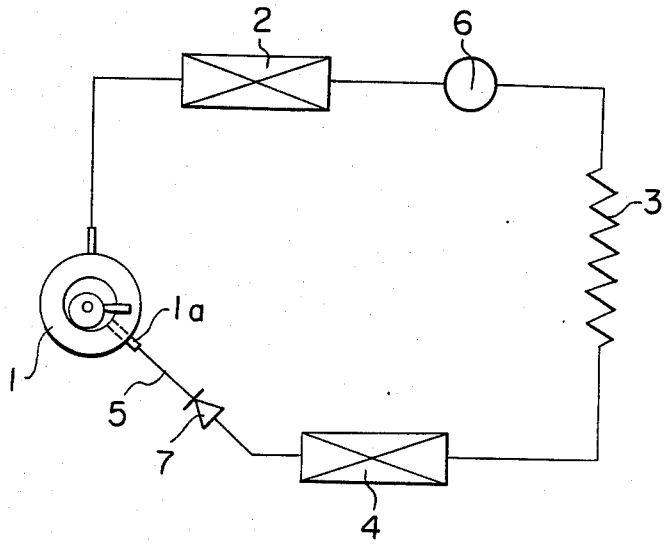
FIG. 1 is a diagram of a conventional refrigeration apparatus.

The reference numeral 8 designates a fluid control valve which is constituted by a controlling part 9, a diaphragm 10 operated in response to a pressure in the controlling part 9, a valve body 11 in association with the diaphragm 10, a spring 12 applying a reactive force to the diaphragm 10, a refrigerant passage 13 and the inlet 14 and the outlet 15 of the refrigerant passage 13, all of which constitute an important part of the apparatus. There is provided a check valve 7 which may be one for preventing the reverse flow of the refrigerant from the side of a compressor 1 to the side of an evaporator 4 at the time of stoppage of the compressor 1.

A first pressure-reducing device 3*a* and a second pressure-reducing device 3*b*, which may be capillary tubes, are connected in series through the inlet 14 and the outlet 15 of the fluid control valve 8 and a series connection of the devices is inserted between the outlet side of the condenser 2 and the inlet side of the evaporator 4 to thereby constitute a pressure-reducing device 3 for a refrigeration circuit.

There is provided a signal transmission path 16 such as a signal transmission pipe which communicates the controlling part 9 of the fluid control valve 8 with the intake port 1*a* of the compressor 1, namely the downstream side of the check valve 7, whereby pressure at the intake port side of the compressor 1 is transmitted to the controlling part 9.

The operation of the refrigeration apparatus constructed as above-mentioned will be described. During cooling operations, a high temperature, high pressure refrigerant discharged from the compressor 1 becomes a high pressure liquid refrigerant by discharging heat in the condenser 2 and the liquid refrigerant is fed to the first pressure-reducing device 3*a* to be subjected to reduction in pressure. Then, the refrigerant enters into the fluid control valve 8 from the inlet 14 and is passed through the refrigerant passage 13 and the outlet 15 to the second pressure-reducing device 3*b* to be subjected to reduction in pressure. In this case, the second pressure-reducing device 3*b* may be of a tube having the same diameter as the first pressure-reducing device 3*a* but having a smaller flow resistance. The refrigerant is led to the evaporator 4 for evaporation 2 to cool the inside of a refrigerator (not shown) and is returned to the compressor through the suction pipe 5*a* and the check valve 7. Refrigeration cycle is thereby performed by repeating the flow of the refrigerant as above-mentioned.

Figure 2:
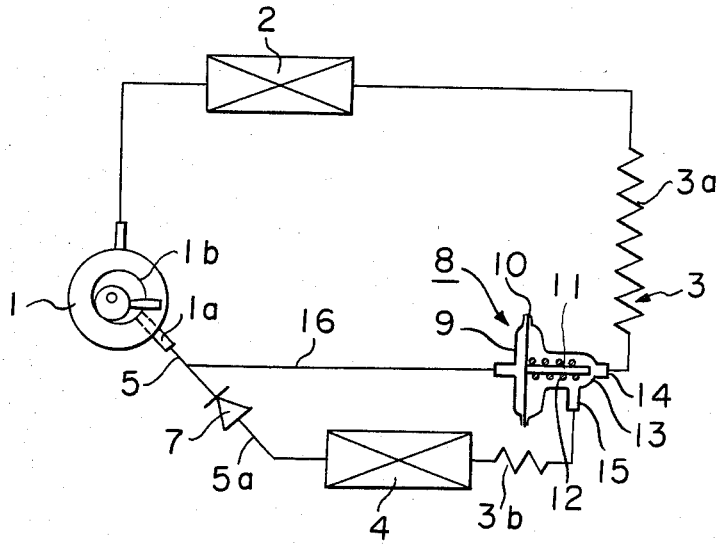
FIG. 2 is a diagram showing a first embodiment of the refrigeration apparatus of the present invention.

During the operation of the compressor 1, namely the cooling operation, a pressure in the controlling part 9 of the fluid control valve 8 and the signal transmission path 16 is lowered to a pressure at the downstream side of the check valve 7 and the urging force as a reactive force of the spring 12 acts on the diaphragm 10 in addition to a pressure at the outlet 15 whereby the valve body 11 is opened and the refrigerant passage 13 maintains its opening state. On the other hand, since the compressor 1 is stopped at the time of stoppage of the cooling operation, the refrigerant of a high temperature, high pressure super-heat gas in the shell 1*b* of the compressor 1 reversely flows from the sliding surface of the compressor 1 toward the suction pipe 5. The reversely flowing refrigerant is prevented from entrance into the evaporator 4 by means of the check valve 7 placed in the suction pipe 5 connecting the compressor 1 with the evaporator 4 and at the same time, the pressure in the suction pipe 5 extending from the compressor 1 to the check valve 7 is changed from a low pressure level to a high pressure level, hence the controlling part 9 and the signal transmisstion path 16 communicated to that part is also instantaneously changed from a low pressure level to a high pressure level, to urge the diaphragm 10 toward the right in FIG. 2. Accordingly, a force caused by the pressure difference between a pressure at the inlet side of the compressor 1 and a pressure at the outlet 15 side of the fluid control valve 8 i.e. a pressure at the inlet side of the second pressure reducing device 3*b* is greater than the urging force of the spring 12 as a reactive force to the diaphragm 10, the valve body 11 is forced by the urging force from of the diaphragm in the direction closing the inlet 14 instantaneously.

When the cooling operation is to be restarted, the actuation of the compressor 1 causes the suction pipe 5 extending from the check valve 7 to the compressor 1 to instantaneously change from the high pressure level at the time of stoppage of the cooling operation to the low pressure level which is a pressure as low as the suction pipe 5*a* between the evaporator 4 and the check valve 7 at the time of stoppage of the cooling operation. Namely, the pressure in the signal transmission path 16 whose one end is connected to the downstream side of the check valve 7 and the controlling part 9 is instanteneously lowered whereby the urging force of the spring 12 is superior to the pressure applied to the diaphragm 10 unlike a state of stoppage of the cooling operation on account of which the valve body 11 is pushed toward the left in FIG. 2 to open the inlet 14, thus the cooling cycle is restarted.

Figure 3:
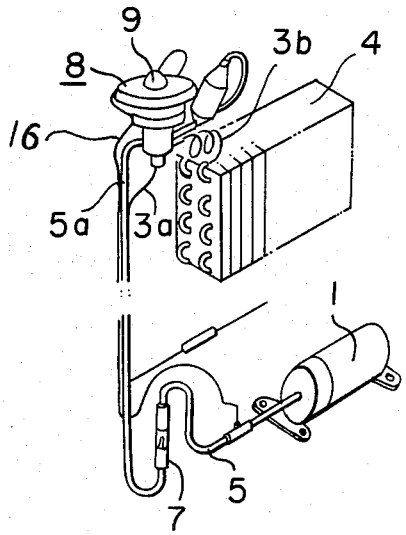
FIG. 3 is a perspective view of a first embodiment of the present invention showing a pressure signal transmission pipe 16 connected to a suction pipe 5*a* by brazing.

Alternatively, it is possible to connect the signal transmission path 16 made of, for example, a metallic pipe to the suction pipe 5*a* by brazing as shown in FIG. 3 so that heat exchanging is carried out. With such construction, the temperature of the reversely flowing gas at a high temperature and a high pressure at the time of stoppage of the compressor 1 is lowered by heat exchange with the suction pipe 5*a* and the low temperature gas is introduced into the controlling part 9 of the fluid control valve 8 thereby preventing temperature rise of the evaporator 4.

Figure 4:
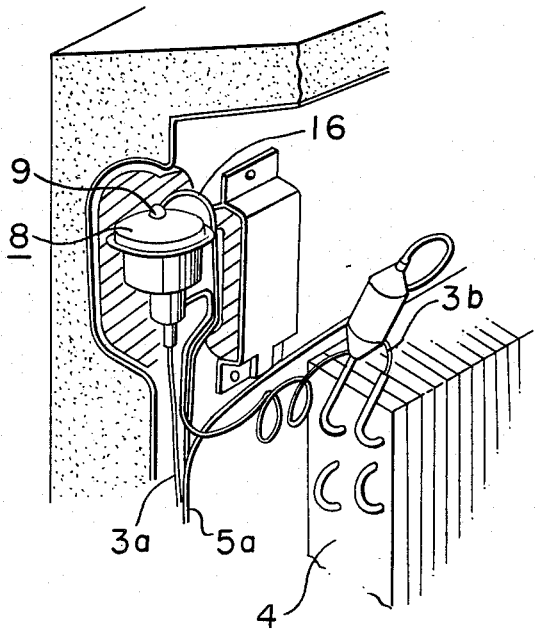
FIG. 4 is a perspective view, partly sectioned, showing a state that a controlling part 9 of a fluid control valve 8 is covered by a heat insulating material.

The heat loss in a highly pressurized gaseous refrigerant flowing to the controlling part 9 through the signal transmisstion path 16 and a highly elevated and highly pressurized gaseous refrigerant flowing through the pressure-reducing device 3 into the inlet 14 at the time of closing of the valve body 11 is prevented by covering the controlling part 9 of the fluid control valve 8 with an insulating material or putting the entirety of the fluid control valve 8 in a wall of a heat insulating material as shown in FIG. 4.

As described above, the first embodiment of the present invention is constructed in such a manner that the pressure-reducing device is divided into the first pressure-reducing device and the second pressure-reducing device, the fluid control valve is placed between the first and second pressure-reducing devices and the fluid control valve is opened and closed due to difference between a pressure at the downstream side of the check valve placed in the suction pipe, namely a pressure at the intake port side of the compressor and a pressure at the inlet side of the second pressure-reducing device. On account of this, the pressure at the outlet side of the fluid control valve is slightly higher than the pressure at the inlet side of the evaporator during the cooling operation and there is a avoidable slow rise of the pressure signal caused by reliquefaction, at the controlling part, of the high temperature, high pressure refrigerant reversely flowing from the compressor through the signal transmission pipe during the time of the stoppage of the cooling operation to thereby obtain quickly a pressure difference imparted to the diaphragm. Accordingly, there is obtainable instantaneous operation of the valve body. In addition, since the fluid control valve is so constructed as to be opened and closed by the pressure difference in the refrigeration circuit, it is possible to constitute the fluid control valve by a diaphragm, a spring, a valve body and so forth and to make the contacting area of the valve body small whereby there is no sound caused by collision of metallic parts during the operation as in the conventional electromagnetic valve to thereby reduce noise to a lower level. Further, electric power for operating the valve is not particularly required. The fluid control device of the present invention is of a simple structure in comparison with the conventional electromagnetic valve and is inexpensive.

A second embodiment of the present invention will be described in detail with reference to FIG. 5, wherein the same reference numerals as in FIG. 1 designate the same or corresponding parts.

A fluid control valve 18 is constituted by a first pressure chamber 19 as a controlling part, a second pressure chamber 20, a diaphragm 21 for defining these chambers, a valve body 22 operating in association with the diaphragm 21, a spring 23 for urging the diaphragm 21 toward the first pressure chamber 19, a refrigerant passage 24 communicating the outlet side of the condenser 2 with the inlet side of the pressure-reducing device 3 such as capillary tube and the inlet 25 and the outlet 26 for the refrigerant passing through the refrigerant passage 24. The inlet 25 is communicated with the outlet side of the condenser 2 and the outlet 26 is communicated with the inlet side of the pressure-reducing device 3.

The valve body 22 is adapted to open and close the inlet 25 depending on pressure difference between the first and second pressure chambers 19, 20. The second pressure chamber 20 is separated from the inlet 25, the outlet 26 and the refrigerant passage 24 in an air-tight manner by a sealing block 27 through which the valve body 22 extends in the refrigerant passage 24.

The reference numeral 28 designates a first signal transmission path, made of a metallic pipe, to transmit a pressure at the intake port side of the compressor 1 to the fluid control valve 18 and is connected between the suction pipe 5 connected to the intake port side of the compressor 1 with respect to the downstream of the check valve 7 and the first pressure chamber 19 of the fluid control valve 18.

The numeral 29 designates a second signal transmission path to transmit a pressure at the outlet side of the evaporator 4 to the fluid control valve 18 and one end of the path 29 is connected to the suction pipe 5*a* extending from the evaporator 4 to the check valve 7 and the other end is connected to the second pressure chamber 20 of the fluid control valve 18.

The operation of the refrigeration apparatus of the second embodiment having the construction as described above will be explained. A high temperature, high pressure refrigerant discharged from the compressor 1 during the cooling operation is introduced into the condenser 2 where it becomes a liquid refrigerant by discharging heat and is passed through the inlet 25 and the outlet 26 of the fluid control valve 18 to the pressure-reducing device 3 to be subjected to pressure reduction. Then, the low pressure refrigerant evaporates in the evaporator 4 to cool the interior of the refrigerator and is returned to the compressor 1 through the suction pipe 5*a* and the check valve 7. Thus, a refrigeration cycle is repeated.

Figure 5:
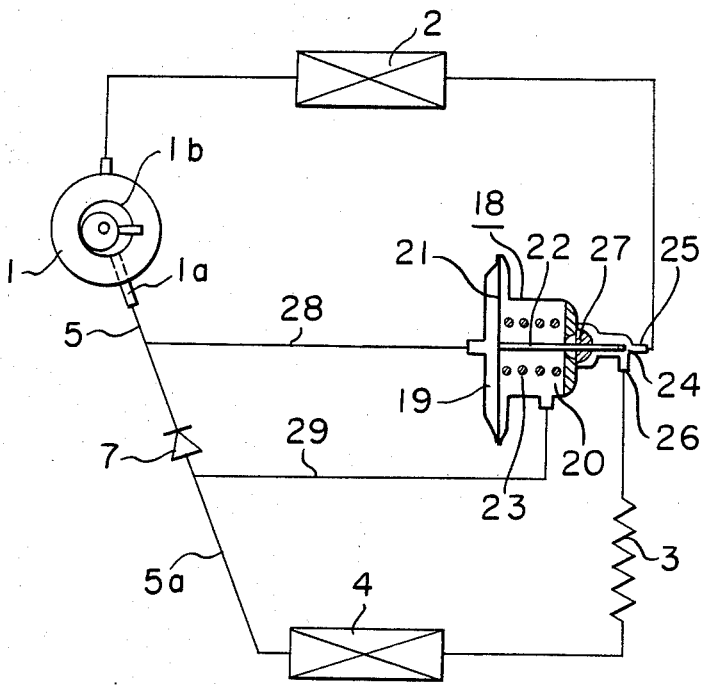
FIGS. 5–8 are respectively diaphragms of the second to the fifth embodiments of the refrigeration apparatus of the present invention.

During the operation of the compressor 1, namely the cooling operation, since the first pressure chamber 19 and the second pressure chamber 20 of the fluid control valve 18 are both at pressures as low as the upstream and downstream of the check valve 7 and the pressure difference between the first pressure chamber 19 and the second pressure chamber 20 is substantially zero, only the reactive force of the spring 23 acts on the diaphragm 21 to push the diaphragm 21 on the left hand in FIG. 5, with the result that the valve body 22 associated with the diaphragm 21 renders the inlet 25 to be in opening state.

On the other hand, when the cooling operation is stopped, namely the compressor 1 is stopped, the refrigerant of a high temperature, high pressure superheated gas in the shell 1*b* of the compressor 1 reversely flows toward the suction pipe 5 through the sliding surface of the compressor 1. The reversely flowing refrigerant causes actuation of the check valve 7 provided in the suction pipe 5 extending between the compressor 1 and evaporator 4, whereby entrance of the refrigerant into the evaporator 4 is prevented and the pressure in the suction pipe 5 extending from the compressor 1 to the check valve 7 is instantaneously changed from a low pressure level to a high pressure level. Accordingly, the first pressure chamber 19 and the first transmission path 28 are instantaneously brought into a high pressure level and the diaphragm 21 is pushed toward the right in FIG. 5 to move the valve body 22 so as to close the inlet 25. At this moment, the second pressure chamber 20 maintains the second signal transmission path 29 and the suction pipe 5*a* extending from the evaporator 4 to the check valve 7 at a low pressure level, with the result that the diaphragm 21 deflects toward the right due to the pressure difference between the first pressure chamber 19 and the second pressure chamber 20 to operate the valve body 22 associated with the diaphragm 21 by overcoming a combined force of the spring 23 which always urges the diaphragm 21 against both of a pressure from the first signal transmission path 28 and a high pressure applied to the inlet 25 and the outlet 26. The operation of the valve body 22 instantaneously closes the inlet 25 to confine a high pressure refrigerant which is apt to move toward the evaporator 4 from the condenser 2; thus the condenser 2 side is kept at a high pressure level.

In the next place, when the cooling operation is to be restarted, the operation of the compressor 1 causes a pressure in the suction pipe 5 extending from the check valve 7 to the compressor 1 to rapidly change from the high pressure level in the time of stoppage of the cooling operation to a low pressure level so that the pressure is equal to the pressure in the suction pipe 5*a* extending from the evaporator 4 to the check valve 7, which is maintained at a low pressure level in the stoppage of the cooling operation. Accordingly, the pressure in the first pressure chamber 19 and the first signal transmission path 28 connected to the suction pipe 5 at the downstream of the check valve 7 and the pressure in the second pressure chamber 20 and the second signal transmission path 29 connected to the suction pipe 5*a* at the upstream of the check valve 7 are also lowered, whereby there is almost no pressure difference between both surfaces of the diaphragm. Consequently, the urging force of the spring 23 moves the valve body 22 in the left hand in FIG. 5 to open the inlet 25 to thereby restart the cooling operation.

In this case, the pressure of the second pressure chamber 20 is completely separated from the high pressure side of the refrigeration circuit since air-tightness is maintained between the a portion consisting of the refrigerant passage 24, the inlet 25 and the outlet 26 of the fluid control valve 18 being kept at the high pressure level and the second pressure chamber 20 by means of the sealing block 27 even in the operation of the valve body 22.

It is possible for the fluid control valve 18 to have a one-piece structure comprising the first and second pressure chambers 19, 20, the diaphragm 21, the spring 23, the valve body 22, the refrigerant passage 24 and the sealing block 27 to obtain a reliable and speedy operation of the valve body 22 and to minimize energy loss.

As described above, the second embodiment of the present invention is so constructed as to open and close the fluid control valve provided at a high pressure side in the refrigerant circuit by use of, as a pressure signal, the pressure difference between the downstream side and the upstream side of the check valve provided in the suction pipe extending from the compressor and the evaporator. With such a construction, the fluid control valve is instantaneously closed at the time of stoppage of the cooling operation to prevent the high pressure refrigerant, which is flowing from the condensor to the evaporator, from flowing on the high pressure side where the condensor is placed. Accordingly, energy loss caused by the high pressure refrigerant flowing toward a low pressure side can be minimized.

Furthur, since the fluid control valve is of the type as being controlled by a diaphragm, there are obtainable advantages of simple structure, small driving power and capable of opening and closing operations with low level of noise and without colliding sound caused by the valve body.

Figure 6:
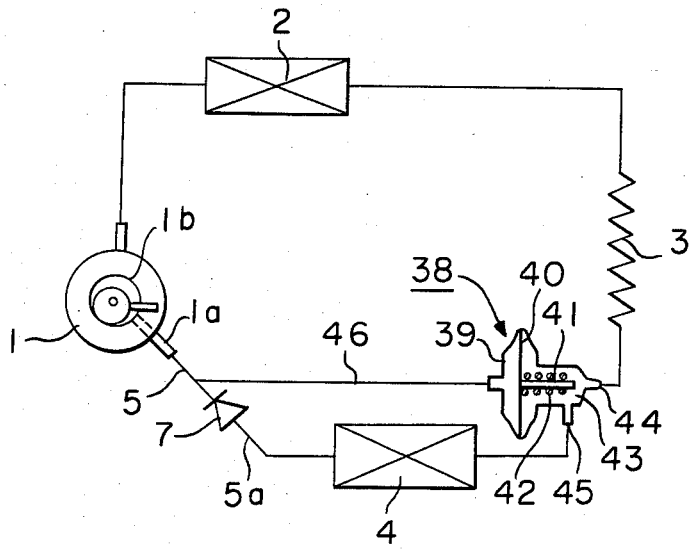

A third embodiment of the present invention will be described with reference to FIG. 6, wherein the same difference numerals as in FIG. 1 designate the same or corresponding parts and the description on these parts is therefore omitted.

A fluid control valve 38 is constituted by a controlling part 39 and a diaphragm 40 operating in response to a pressure in the controlling part 39, a valve body 41 associated with the diaphragm 40, a spring 42 applying a reactive force to the diaphragm 40, a refrigerant passage 43 and the inlet 44 and the outlet 45 of the refrigerant passage 43, all of which constitute an important part of the device. The inlet 44 is connected to the outlet side of the pressure-reducing device 3 such as a capillary tube; the outlet 45 is connected to the inlet side of the evaporator 4 and the outlet of the evaporator 4 is connected to the intake port 1*a* of the compressor 1 through the suction pipe 5 provided with the check valve 7; thus a vapor compression type refrigeration circuit is thereby constituted.

Further there is provided a signal transmission path 46 such as a signal transmission pipe which communicates the controlling part 39 of the fluid control valve 38 with the intake port 1*a* of the compressor 1, namely the downstream side of the check valve 7 so that a pressure at the intake port side of the compressor 1 is transmitted to the controlling part 39.

The operation of the refrigeration apparatus of the third embodiment will be described. In the cooling operation, a high temperature, high pressure refrigerant discharged from the compressor 1 is introduced into the condenser 2 where the refrigerant becomes a high pressure liquid refrigerant by discharging heat and is fed to the pressure-reducing device 3. In the pressure-reducing device 3, the refrigerant is subjected to pressure reduction to be a low pressure refrigerant. The low pressure refrigerant flows into the inlet 44 of the fluid control valve 38 and reaches the outlet 45 through the refrigerant passage 43 because the valve body 41 is opened at the moment. The refrigerant evaporates in the evaporator 4 to cool the interior of a refrigerator, after which it is returned to the compressor 1 from the outlet of the evaporator 4 through the suction pipe 5*a* at the outlet side of the evaporator 4, the check valve 7 and the suction pipe 5.

In the cooling operation, the inlet 44, the refrigerant passage 43 and the outlet 45 of the fluid control valve 38 and the evaporator 4 are at a low pressure and the pressure of the suction pipe 5 extending between the intake port 1*a* of the compressor 1 and the check valve 7 is also lowered, on account of which the signal transmission path 46 and the controlling part 39 communicated with the suction pipe 5 also changes to a low pressure level. As a result, both sides of the diaphragm 40 are substantially at the same pressure level because pressure difference between the controlling part 39 and the outlet 45 disappears and the urging force of the spring 42 acting on the diaphragm 40 in the counter direction pushes the diaphragm 40 toward the left in FIG. 6 whereby the valve body 41 associated with the diaphragm 40 is moved to open the inlet 44.

On the other hand, when the cooling operation is stopped, the compressor 1 is deenergized to cause the refrigerant of a high temperature, high pressure superheated gas in the shell 1*b* to reversely flow into the suction pipe 5 through the sliding surface of the compressor 1. The reversely flowing refrigerant actuates the check valve 7 provided in the suction pipe 5 to prevent the refrigerant from reversely flowing whereby the suction pipe extending between the compressor 1 and the check valve 7 rapidly reaches a high pressure level and this condition causes the pressures of the suction pipe 5 at the intake port side of the compressor 1 and the controlling part 39 of the fluid control valve 38 to be at a high pressure level to push the diaphragm 40 toward the right in FIG. 6. When the pressure applied to the controlling part 39 is greater than the sum of the urging force of the spring 42 and the low pressure at the outlet 45, the valve body 41 is pushed to a valve seat (not shown) at the inlet 44 to instantaneously close the inlet.

At the starting of the cooling operation, pressures in the controlling part 39, the signal transmission path 46 and the suction pipe 5 extending from the check valve 7 to the intake port 1*a* of the compresor 1 are rapidly lowered and if the pressure of the controlling part 39 defined by the diaphragm 40 is smaller than the pressure at the outlet, namely the pressure at the inlet side of the evaporator 4, the valve body 41 is moved to open the inlet 44 by means of the spring 42 urging the diaphragm 40 whereby a normal cooling operation is initiated.

In the third embodiment of the present invention, since the fluid control valve is operated depending on difference between a pressure at the intake port side of the compressor and a pressure at inlet of the evaporator to open and close the refrigeration circuit, the structure of the fluid control valve comprising the diaphragm, the spring and the valve body can be minimized as well as the contacting area of the valve body and the valve seat.

Accordingly, the refrigeration apparatus of the present invention operates with a low level of noise without any sound caused by collision of metallic parts during the operations as in the conventional electromagnetic valve. Further, it does not require much electic power because the valve is operated by the movement of the diaphragm; prevents energy loss caused by repeated operations and the stoppages for the cooling operation and is inexpensive because the valve structure is simple in comparision with the conventional electromagnetic valve.

The fourth embodiment of the present invention will be described with reference to FIG. 7, wherein the same reference numerals as in FIG. 1 designate the same or corresponding parts and description on these parts is therefore omitted.

A fluid control valve 58 is constituted by a first pressure chamber 59 forming a controlling part, a second pressure chamber 60, a diaphragm 61 defining the pressure chambers, a valve body 62 operataing in association with the diaphragm 61, a spring 63 urging the diaphragm 61 toward the first pressure chamber 59, a refrigerant passage 64 connecting the outlet side of the condenser 2 to the inlet side of the pressure-reducing device 3 such as a capillary tube and the inlet 65 and the outlet 66 for the refrigerant passage 64. The inlet 65 is communicated with the outlet side of the condenser 2 and the outlet 66 is communicated with the inlet side of the pressure-reducing device 3 respectively.

The valve body 62 is adapted to open and close the inlet 65 depending on a pressure difference between the first and second pressure chambers 59, 60. The second pressure chamber 60 is defined by a sealing block 67 which air-tightly seals it to the inlet 65, the outlet 66 and the refrigerant passage 64, the valve body 62 extending from the second pressure chamber 60 to the refrigerant passage 64 in an air-tight manner. A first pressure signal transmission pipe 68 for transmitting a pressure at the intake port side of the compressor 1 to the fluid control valve 58 extends between the suction pipe 5 connected to the intake port side of the compressor 1 and the first pressure chamber 59 of the fluid control valve 58. A second pressure signal transmission pipe 69 for transmitting a pressure at the outlet side of the evaporator 4 to the fluid control valve 58 is connected between the suction pipe 5*a* extending from the evaporator 4 to the check valve 7 and the second pressure chamber 60 of the fluid control valve 58. These pressure signal transmission pipes 68, 69 are constituted by capillary tubes each having a diameter smaller than the inner diameter of the suction pipe 5 for the purpose of attenuating pulsation of the refrigerant, which takes place during the operation in the compressor. Further, a looped portion or a coiled portion 70 or 71 is formed in each of the pressure signal transmission pipes 68, 69 to attenuate pulsation in the refrigerant caused during the operation of the compressor.

The operation of the fourth embodiment of the refrigeration apparatus constructed as above-mentioned will be described. The high temperature, high pressure refrigerant discharged from the compressor 1 during the cooling operation is subjected to heat radiation in the condenser 2 to be a high pressure liquid refrigerant and it is passed through the inlet 65 and the outlet 66 of the fluid control valve 58 to the pressure-reducing device 3 for performing pressure reduction. The low pressure refrigerant whose pressure is reduced in the pressure-reducing device 3 is fed to the evaporator 4 where it evaporates to cool the interior of the refrigerator and the gaseous refrigerant is returned to the compressor 1 through the check valve 7 connected to the suction pipe 5*a;* thus, a cooling cycle is repeated.

Figure 7:
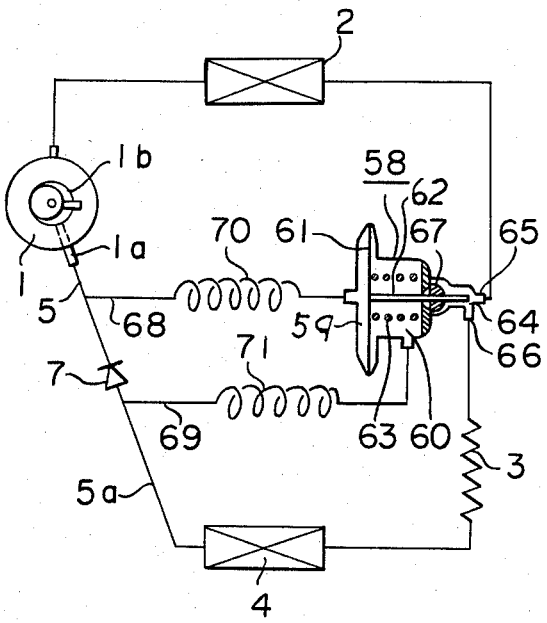

When the compressor 1 is operated to perform cooling operation, the first pressure chamber 59 and the second pressure chamber 60 of the fluid control valve 58 are kept at pressures as low as the upstream and the downstream of the check valve 7 and there is almost no pressure difference between the first pressure chamber 59 and the second pressure chamber 60, whereby the diaphragm 61 receives only the reactive force of the spring 63 to be moved on the left hand of FIG. 7 so that the valve body 62 associated with the diaphragm closes the inlet 65.

During the operation of the compressor, pulsation of the gaseous refrigerant produced due to the revolution of a piston is transmitted to the first pressure chamber 59 of the fluid control valve to effect adversely the operational characteristic and the life time of the diaphragm 61. To attenuate the pulsation, the pressure-signal transmission pipes 68, 69 are constituted by capillary tubes having an inner diameter smaller than that of the suctaion pipe 5 and further, a looped or coiled portion is formed in the pipes.

On the other hand, when the compressor 1 is stopped, hence the cooling operation is stopped, the refrigerant of a high temperature, high pressure super-heated gas in the shell 1*b* of the compressor 1 reversely flows on the suction pipe 5 side through the sliding surface of the compressor 1. The reversely flowing refrigerant actuates the check valve 7 provided in the suction pipe 5 and between the compressor 1 and the evaporator 4 to prevent the refrigerant from flowing into the evaporator 4 and to cause a pressure in the suction pipe 5 extending from the compressor 1 to the check valve 7 to instantaneously change from a low pressure level to a high pressure level. Accordingly, the first chamber pressure 59 and the first signal transmission path 68 instantaneously change from low pressure condition to high pressure condition to thereby push the diaphragm 61 toward the right in FIG. 7 so that the valve body 62 is moved in the direction to close the inlet 65.

At the moment, the second pressure chamber 60 maintains the second signal transmission path 69 and the suction pipe 5*a* extending from the evaporator 4 to the check valve 7 at a low pressure level. As a result, the diaphragm 11 deflects toward the right by receiving a pressure difference between the first pressure chamber 59 and the second pressure chamber 60 and by overcoming the sum of the reactive force of the spring 63 against the diaphragm 61 and a high pressure at the inlet 65 and the outlet 66 to move the valve body 62 associated with the diaphragm 61, with the consequence that the inlet 65 is instantaneously closed and the high pressure refrigerant flowing from the condenser 2 toward the evaporator 4 side is confined at the high pressure side of the refrigeration circuit including the condenser 2.

At the restarting of the cooling operation, the operation of the compressor 1 instantaneously changes the pressure in the suction pipe 5 extending from the check valve 7 to the compressor 1 from the high pressure level kept during the stoppage of the compressor 1 to the low pressure level whereby the pressure in the suction pipe 5*a* is equal to the pressure in the suction pipe 5*a* extending from the evaporator 4 to the check valve 7, which maintains the low pressure during the stoppage of the compressor 1. Accordingly, the pressures in the first pressure chamber 59 and the first signal transmission path 68 communicated with the downstream of the check valve 7 and the second pressure chamber 60 and the second signal transmission path 69 communicated with the upstream of the check valve 7 are also lowered to a low pressure level on account of which there is almost no pressure difference between the two sides of the diaphragm 61. In addition, the pulsation in the pressure signal caused by the compressor 1 can be attenuated by using capillary tubes as the pressure signal transmission pipes 68, 69 and by forming the capillary tubes in a looped or coiled shape whereby there is no adverse effect to the diaphragm 61 of the fluid control valve. As the result of the construction as above-mentioned, the valve body 62 is moved on the left hand in FIG. 7 by the urging force of the spring 63 to open the inlet 65 to thereby restart the cooling operation.

In the refrigeration apparaturs of the fourth embodiment, since air-tightness is maintained between the second pressure chamber 60 to be sealed and the refrigerant passage 64, the inlet 65 and the outlet 66 of the fluid control valve 58 at a high pressure side, by means of the sealing block 67 through which the valve body 62 extends, even during the operation of the valve body 62, the pressure in the second pressure chamber is effectively separated from the portion of the refrigeration circuit kept at a high pressure level.

Briefly, the fourth embodiment of the present invention is constructed in such a manner that a check valve is provided between a compressor and an evaporator, pressure difference between the upstream side and the downstream side of the check valve is used as a pressure signal to be fed to the fluid control valve placed at a high pressure side of a refrigerant circuit to control the ON-OFF operation of the fluid control valve and pressure signal transmission pipes connected to the fluid control valve are constituted by fine tubes such as capillary tubes, the pipes being formed in a looped shape. With the construction of the refrigeration apparatus, pulsation in a refrigerant generated during the operation of the compressor is reduced to protect a diaphragm and to make the cooling operation stable. Further, the fluid control valve is instantaneously closed at the time of stoppage of the cooling operation to confine a high pressure refrigerant flowing from the condenser 2 toward the evaporator to the high pressure side in the refrigeration circuit including the condenser to thereby minimize energy loss which is caused by the high pressure refrigerant flowing on the low pressure side.

Since the fluid control valve is of the type controlled by the diaphragm, the structure of the fluid control valve is simple; does not require much electric power for driving and performs open and close controlling with a low level of noise without causing any colliding sound generated by the valve body.

Figure 8:
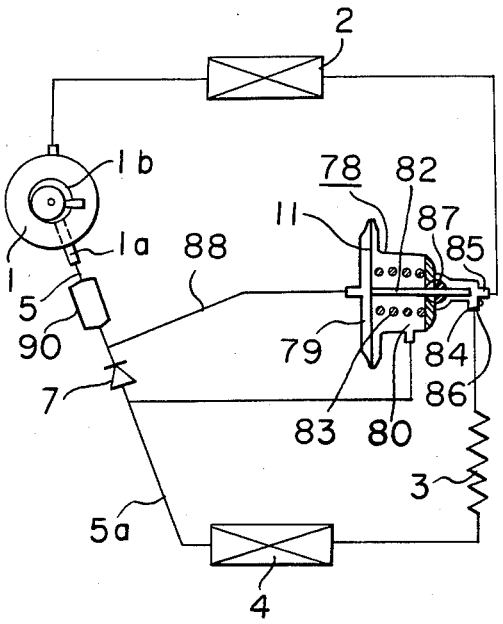

Finally, the fifth embodiment of the present invention will be described with reference to FIG. 8. In FIG. 8, the same reference numerals as in FIG. 1 designate the same or corresponding parts and description on these parts is therefore omitted.

A fluid control valve 78 is constituted by a first pressure chamber 79 as a controlling part, a second pressure chamber 80, a diaphragm 81 defining these pressure chambers, a valve body 82 operating in association with the diaphragm 81, a spring 83 for urging the diaphragm 81 toward the first pressure chamber 79, a refrigerant passage 84 connected between the outlet side of the condenser 2 and the inlet side of the pressure-reducing device 3 made as a capillary tube and an inlet 85 and an outlet 86 of the refrigerant passage 84. The inlet 85 is communicated with the outlet side of the condenser 2 and the outlet 86 is communicated with the inlet side of the pressure-reducing device 3 respectively.

The valve body 82 is adapted to open and close the inlet 85 depending on pressure difference between the first pressure chamber 79 and the second pressure chamber 80. The second pressure chamber 80 is sealed with respect to the inlet 85, the outlet 86 and the refrigerant passage 84 by means of a sealing block 87 through which the valve body 82 extends.

A first pressure signal transmission pipe 88 is connected between the suction pipe 5 extending from the intake port side of the compressor 1 to the check valve 7 and the first pressure chamber 79 of the fluid control valve 78 to transmit a pressure at the intake port side of the compressor 1 to the fluid control valve 78.

A second pressure signal transmission pipe 89 is connected between the suction pipe 5*a* extending from the evaporator 4 to the check valve 7 and the second pressure chamber 80 of the fluid control valve 78 to transmit a pressure at the outlet side of the evaporator 4 to the fluid control valve 78.

An expansion type muffler 90 is connected to the suction pipe 5 on the compressor 1 side to attenuate pulsation of the refrigerant produced during the operation of the compressor.

The operation of the refrigeration apparatus constructed as above-mentioned will be described. A high temperature, high pressure refrigerant discharged from the compressor 1 in the cooling operation becomes a high pressure liquid refrigerant in the condenser 2 by discharging heat, and then is passed through the inlet 85 and the outlet 86 of the fluid control valve 78 to the pressure-reducing device 3 where the high pressure refrigerant is subjected to reduction in pressure. A low pressure refrigerant in the pressure-reducing device 3 is fed to the evaporator 4 and evaporates to cool the interior of a refrigerator and then the gaseous refrigerant is passed through the suction pipe 5*a*, the check valve 7 and the muffler 90 to the compressor 1; thus, a cooling cycle is repeated.

In the cooling operation during which the compressor 1 operates, the first pressure chamber 79 and the second pressure chamber 80 of the fluid control valve 78 maintain the pressure at a low level which is equal to those of the upstream side and the downstream side of the check valve 7 and the pressure difference between the first and second pressure chambers 79, 80 is almost zero whereby the diaphragm 81 receives only the reactive force of the spring 83 to urge the diaphragm 81 toward the left in FIG. 8 thereby rendering the inlet 85 to be opened by means of the valve body 82 associated with the diaphragm 81.

When the compressor is operated, pulsation in the gaseous refrigerant is caused due to the revolution of a piston and thus produced pulsating pressure is transmitted to the first pressure chamber 89 of the fluid control valve 78 to adversely affect to the life time of the diaphragm 81. To eliminate such disadvantage, the muffler 90 is connected to the suction pipe 5 on the compressor side with respect to the first pressure signal transmission pipe to reduce the pulsation.

When the cooling operation is stopped by stopping the compressor 1, the refrigerant of high temperature, high pressure super-heat gas in the shell 1*b* of the compressor 1 reversely flows on the side of the suction pipe 5 through the sliding surface of the compressor 1. The reversely flowing refrigerant actuates the check valve 7 provided in the suction pipe 5 extending from the compressor 1 to the evaporator 4 to prevent the refrigerant from flowing into the evaporator 4 so as to instantaneously change the pressure in the suction pipe 5 extending between the compressor 1 and the check valve 7 from a low pressure level to a high pressure level.

Accordingly, the pressure in the first pressure chamber 79 and the first pressure signal transmission pipe 88 instantaneously change from a low level to a high level to urge the diaphragm 81 toward the right in FIG. 8 to thereby close the inlet 85 by the valve body 82.

At this moment, the second pressure chamber 80 maintains the second pressure signal transmission pipe 89 and the suction pipe 5*a* extending from the evaporator 4 to the check valve 7 at the low pressure level. As a result, the diaphragm 81 is deflected toward the right by receiving the pressure difference between the first pressure chamber 79 and the second pressure chamber 80 to cause the valve body 82 associated with the diaphragm 81 to operate by overcoming the sum of the reactive force of the spring 83 urging the diaphragm in the opposite direction and force caused by a high pressure applied to the inlet 85 and the outlet 86. The operation of the valve body 82 instantaneously closes the inlet 85 to confine the high pressure refrigerant flowing from the condenser 2 toward the evaporator 4 at the high pressure side of the refrigeration circuit including the condenser 2.

When the cooling operation is to be restarted, the actuation of the compressor 1 instantaneously changes the pressure in the suction pipe 5 extending from the check valve 7 through the muffler 90 to the compressor 1 from the high level during the time of stoppage of the compressor 1 to the low level whereby the pressure in the suction pipe 5 is equal to that of the suction pipe 5*a* extending from the evaporator 4 to the check valve 7 which has been at a low level during the stoppage of the compressor 1. Accordingly, both the pressure in the first pressure chamber 79 and the pressure signal transmission pipe 88 which are communicated with the downstream of the check valve 7 and the pressure in the second pressure chamber 80 and the second pressure signal transmission pipe 89 which are communicated with the upstream of the check valve 7 reach a low level on account of which there is almost no pressure difference between both sides of the diaphragm 81. In addition, the pulsation transmitted from the compressor 1 is attenuated by the muffler 90 to minimize any adverse effect to the diaphragm 81 of the fluid control valve 78. Consequently, the urging force of the spring 83 moves the valve body 82 toward the left in FIG. 8 to open the inlet 85; thus the cooling operation is restarted.

In the refrigeration apparatus of the fifth embodiment, since the second pressure chamber 80 required to have air-tightness is sealed by a sealing block 87 with respect to the refrigerant passage 84, the inlet 85 and the outlet 86 of the fluid control valve 78 provided at the high pressure side even in the operation of the valve body 82 extending through the sealing block 87, the pressure in the second pressure chamber is effectively breaked from the refrigeration circuit kept at the high pressure side without any adverse effect in pressure.

As described above, the fifth embodiment of the present invention is constructed in such a manner that a check valve is provided between a compressor and an evaporator, pressure difference between the upstream side and the downstream side of the check valve is used as a pressure signal so as to open and close a fluid control valve provided at the high pressure side of the refrigeration circuit and a pressure signal transmission pipe is connected between the check valve and a muffler. With the construction described above, pulsation produced in the operation of the compressor is attenuated to protect a diaphragm of the fluid control valve and to enable the fluid control valve to operate in a stable manner. In addition, a high pressure refrigerant flowing from a condenser toward the evaporator is rapidly confined at the high pressure side of the refrigeration circuit including the condenser to minimize energy loss caused by the high pressure refrigerant flowing toward the low pressure side in the refrigeration circuit.

Further, since the fluid control valve is of a type controlled by the diaphragm, the structure is simple, electric power for driving can be small and there is obtainable opening and closing control with low noise without any colliding sound generated from the valve body.

I claim:

1. A refrigeration apparatus comprising a compressor, a condenser, a pressure-reducing device and an evaporator connected sequentially in a refrigeration loop which comprises:

a check valve placed in said loop between an outlet of said evaporator and an intake port of said compressor to prevent a refrigerant from flowing from the compression side to the evaporator side of said compressor;

a pressure signal transmission pipe having one end connected to an outlet of said check valve for applying a pressure corresponding to the refrigerant pressure at the outlet side of said check valve; and a fluid control valve in said loop positioned at an inlet side of said pressure reducing device and communicated with another end of said pressure signal transmission pipe for controlling the refrigerant flowing to said inlet side of said pressure-reducing device in response to the refrigerant pressure in said another end of said pressure signal transmission pipe, wherein said fluid control valve has first and second pressure chambers defined by a diaphragm and a valve body for opening and closing a refrigerant pressure in said loop in response to movement of said diaphragm, said first pressure chamber being connected to said another end of said pressure signal transmission pipe and said second pressure chamber receiving a pressure at an inlet side of said check valve, and a second pressure signal transmission pipe having one end connected between said inlet side of said check valve and said outlet side of said evaporator and having another end connected to said second pressure chamber of said fluid control valve, whereby said fluid control valve opens and closes said loop depending on a pressure difference between said inlet side and said outlet side of said check valve.

* * * * *